US008763200B2

(12) United States Patent
Kim et al.

(10) Patent No.: US 8,763,200 B2
(45) Date of Patent: Jul. 1, 2014

(54) ROBOT CLEANER

(75) Inventors: Dong Won Kim, Hwaseong-si (KR); Jun Hwa Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/610,193

(22) Filed: Sep. 11, 2012

(65) Prior Publication Data

US 2013/0081218 A1 Apr. 4, 2013

(30) Foreign Application Priority Data

Sep. 30, 2002 (KR) ..... 10-2011-0099648

(51) Int. Cl.
*A47L 5/00* (2006.01)
*A47L 11/00* (2006.01)
*E01H 1/08* (2006.01)

(52) U.S. Cl.
CPC ..... *A47L 5/00* (2013.01); *A47L 2301/00* (2013.01); *E01H 1/08* (2013.01)
USPC ..... 15/319; 15/340.1

(58) Field of Classification Search
CPC ..... E01H 1/00; E01H 1/08; A47L 5/00; A47L 5/12; A47L 11/00; A47L 2301/00
USPC ..... 15/319, 340.1, 340.3, 49.1, 98
IPC ..... A47L 5/00,5/12, 11/00; E01H 1/08
See application file for complete search history.

(56) References Cited

U.S. PATENT DOCUMENTS

| | | | | |
|---|---|---|---|---|
| 7,275,280 | B2 * | 10/2007 | Haegermarck et al. | 15/340.1 |
| 8,370,990 | B2 * | 2/2013 | Yu et al. | 15/319 |
| 2006/0053580 | A1 * | 3/2006 | Woo | 15/319 |
| 2008/0276407 | A1 * | 11/2008 | Schnittman et al. | 15/319 |
| 2012/0090126 | A1 * | 4/2012 | Kim et al. | 15/319 |

FOREIGN PATENT DOCUMENTS

JP 2009015667 A * 1/2009

* cited by examiner

*Primary Examiner* — David Redding
(74) *Attorney, Agent, or Firm* — Staas & Halsey LLP

(57) ABSTRACT

A robot cleaner to perform cleaning without interruption of travel when passing over an obstacle. The robot cleaner includes a main body, and drive devices at left and right sides of the main body. Each drive device includes a main wheel to drive the main body, a drive motor to rotate the main wheel, a gear assembly to transmit power from the drive motor to the main wheel, a drive shaft to assist the main wheel in rotating by rotation power, and an auxiliary wheel connected to a distal end of the drive shaft so as to be located closer to the center of the main body than the main wheel. If the main wheel is lifted from a floor when passing over an obstacle during traveling, the auxiliary wheel protrudes downward to reach the floor, assisting the main body in traveling to escape from the obstacle.

24 Claims, 9 Drawing Sheets

ROBOT CLEANER

CROSS-REFERENCE TO RELATED APPLICATIONS

This application claims the benefit of Korean Patent Application No. 2011-0099648, filed on Sep. 30, 2011 in the Korean Intellectual Property Office, the disclosure of which is incorporated herein by reference.

BACKGROUND

1. Field

Embodiments of the present disclosure relate to a robot cleaner having an improved configuration to enable implementation of a cleaning operation without interruption of travel.

2. Description of the Related Art

In general, a robot cleaner is an apparatus that automatically cleans a target area to be cleaned by suctioning impurities, such as dust, etc., from a floor while autonomously traveling about the area without user intervention.

The robot cleaner functions to detect a distance from an obstacle, such as furniture, office appliances and walls, present in the cleaning area using a variety of sensors, and to clean the target area while traveling without collision with the obstacle based on detected information.

Cleaning a given cleaning area using the robot cleaner means an operation in which the robot cleaner repeatedly performs a cleaning operation while traveling in the cleaning area based on a preset traveling pattern.

Obstacles present in a cleaning area where the robot cleaner travels include an obstacle, such as a doorsill, that the robot cleaner must pass over.

When passing over, e.g., the doorsill present in the cleaning area, however, the center of the robot cleaner may be caught by the doorsill, causing separation of a wheel, and consequently interruption of travel of the robot cleaner.

SUMMARY

Therefore, it is one aspect of the present disclosure to provide a robot cleaner having a configuration to enable implementation of a cleaning operation without interruption of travel due to an obstacle present in a cleaning space when the robot cleaner passes over the obstacle.

Additional aspects of the disclosure will be set forth in part in the description which follows and, in part, will be apparent from the description, or may be learned by practice of the disclosure.

In accordance with one aspect of the present disclosure, a robot cleaner includes a main body and drive devices installed respectively at left and right peripheral positions on the basis of the center of the main body to drive the main body, wherein each of the drive devices includes a main wheel to drive the main body, a drive motor to generate rotation power required to rotate the main wheel, a gear assembly to transmit rotation power of the drive motor to the main wheel, a drive shaft to interconnect the gear assembly and the main wheel so as to assist the main wheel in rotating by rotation power transmitted from the gear assembly, the drive shaft extending from the main wheel toward the center of the main body, and an auxiliary wheel to drive the main body, the auxiliary wheel being connected to a distal end of the drive shaft extending toward the center of the main body so as to be located closer to the center of the main body than the main wheel, and wherein, if the main wheel is lifted from a floor as the main body is caught at the center thereof by an obstacle when passing over the obstacle during traveling, the auxiliary wheel protrudes downward of the main body to reach the floor, assisting the main body in traveling to escape from the obstacle.

The main body may include a main brush to sweep or scatter dust present in a cleaning space, thus achieving improved dust suction efficiency, and the main brush may be installed between the main wheels at a rear bottom region of the main body.

The main brush may extend by a long length such that left and right ends of the main brush are located close to the rim of the main body to ensure that the main brush cleans a wide cleaning space via one revolution thereof.

The main wheels may be installed close to left and right rim positions of the main body to allow the left and right ends of the main brush between the main wheels to be located close to the rim of the main body, and the gear assembly may be installed between a corresponding one of the main wheels and the center of the main body.

The drive device may include a housing in which the main wheel and the gear assembly are received, and the housing may have an open bottom to enable upward and downward movement of the main wheel.

The housing may have a first coupling hole for insertion of a rotating shaft of the drive motor, and the gear assembly may have a second coupling hole for insertion of the rotating shaft inserted into the first coupling hole.

The housing may have a first coupling boss aligned on the same axis as the rotating shaft so as to be coupled to the gear assembly, the gear assembly may have a second coupling boss to couple the gear assembly to the housing, and the first coupling boss may have a receiving hole in which the second coupling boss is pivotally received such that the gear assembly is pivotable about the first coupling boss.

The gear assembly may have a third coupling hole for insertion of the drive shaft, and the housing may have a guide slot for penetration of the drive shaft inserted into the third coupling hole, whereby the drive shaft having passed through the guide slot extends toward the center of the main body.

The auxiliary wheel may be connected to a distal end of the drive shaft penetrating the guide slot, and may be located outside of the housing.

The main wheel, the gear case and the auxiliary wheel, which are connected to one another via the drive shaft, may be moved upward and downward via rotation thereof about the rotating shaft of the drive motor, and the guide slot may guide rotation of the drive shaft about the rotating shaft.

An outer diameter of the auxiliary wheel may be less than an outer diameter of the main wheel.

In accordance with another aspect of the present disclosure, a robot cleaner includes a main body, a main brush installed at a rear bottom region of the main body, and drive devices installed respectively at left and right peripheral positions on the basis of the center of the main body to drive the main body, wherein each of the drive devices includes a main wheel to drive the main body, a drive motor to generate rotation power required to rotate the main wheel, a gear assembly to transmit rotation power of the drive motor to the main wheel, a drive shaft to interconnect the gear assembly and the main wheel so as to assist the main wheel in rotating by rotation power transmitted from the gear assembly, and an auxiliary wheel connected to the drive shaft to drive the main body, the auxiliary wheel being located closer to the center of the main body than the main wheel, and wherein the main wheel is located closer to the rim of the main body than the gear assembly to allow the main brush between the main wheels to extend by a long length such that left and right ends of the main brush are located close to the rim of the main body.

If the main wheel is lifted from a floor as the main body is caught at the center thereof by an obstacle when passing over the obstacle during traveling, the auxiliary wheel may protrude downward of the main body to reach the floor, assisting the main body in traveling to escape from the obstacle.

The drive device may include a housing in which the main wheel and the gear assembly are received, and the housing may have an open bottom to enable upward and downward movement of the main wheel.

The housing may have a first coupling hole for insertion of a rotating shaft of the drive motor, and the gear assembly may have a second coupling hole for insertion of the rotating shaft inserted into the first coupling hole.

The housing may have a first coupling boss aligned on the same axis as the rotating shaft so as to be coupled to the gear assembly, the gear assembly may have a second coupling boss to couple the gear assembly to the housing, and the first coupling boss may have a receiving hole in which the second coupling boss is pivotally received such that the gear assembly is pivotable about the first coupling boss.

The gear assembly may have a third coupling hole for insertion of the drive shaft, and the housing may have a guide slot for penetration of the drive shaft inserted into the third coupling hole, whereby the drive shaft having passed through the guide slot extends toward the center of the main body.

The auxiliary wheel may be connected to a distal end of the drive shaft penetrating the guide slot, and may be located outside of the housing.

The main wheel, the gear case and the auxiliary wheel, which are connected to one another via the drive shaft, may be moved upward and downward via rotation thereof about the rotating shaft of the drive motor, and the guide slot may guide rotation of the drive shaft about the rotating shaft.

An outer diameter of the auxiliary wheel may be less than an outer diameter of the main wheel.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
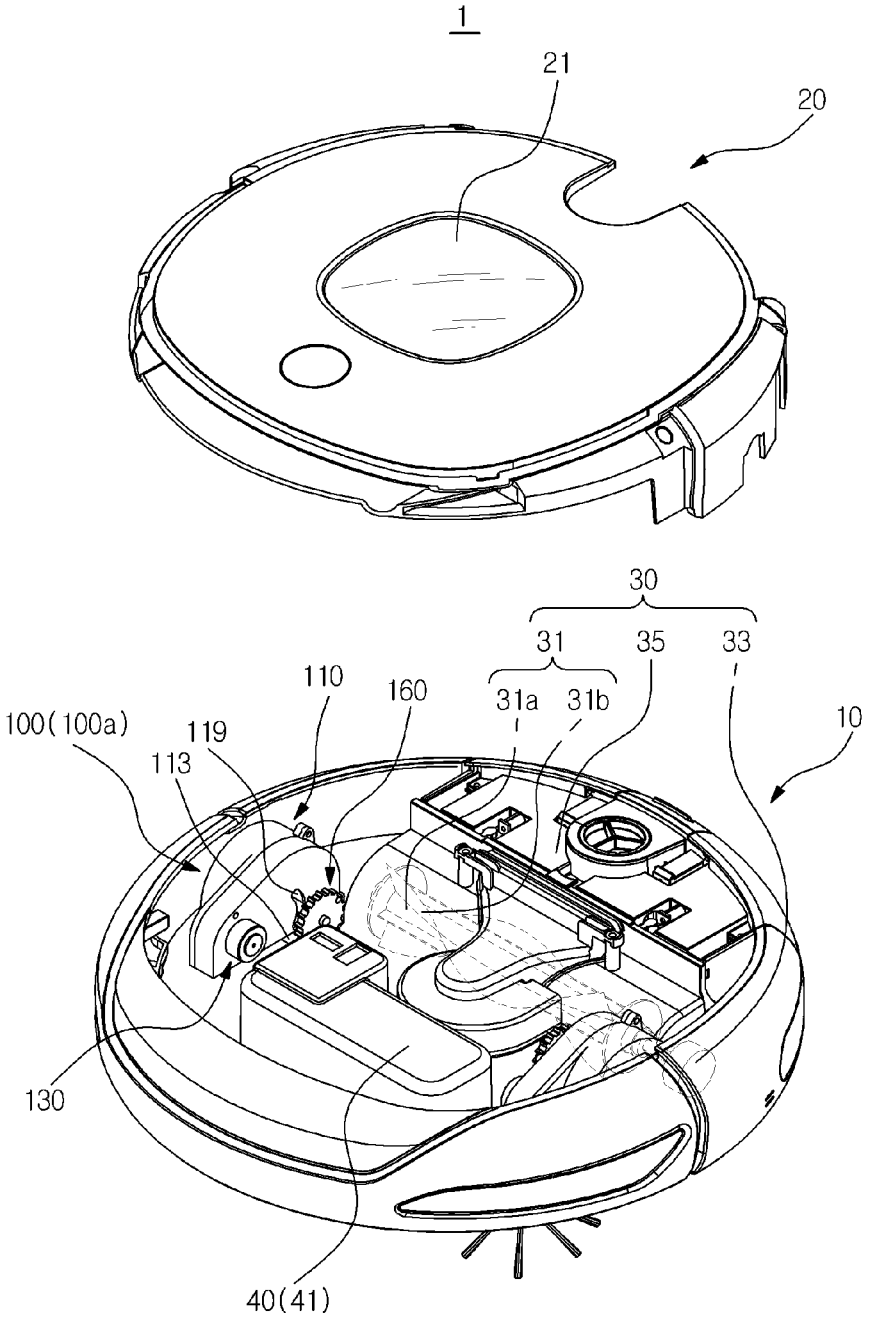
FIG. 1 is a perspective view showing a configuration of a robot cleaner according to an embodiment of the present disclosure.

Reference will now be made in detail to the embodiments of the present disclosure, examples of which are illustrated in the accompanying drawings, wherein like reference numerals refer to like elements throughout.

Figure 2:
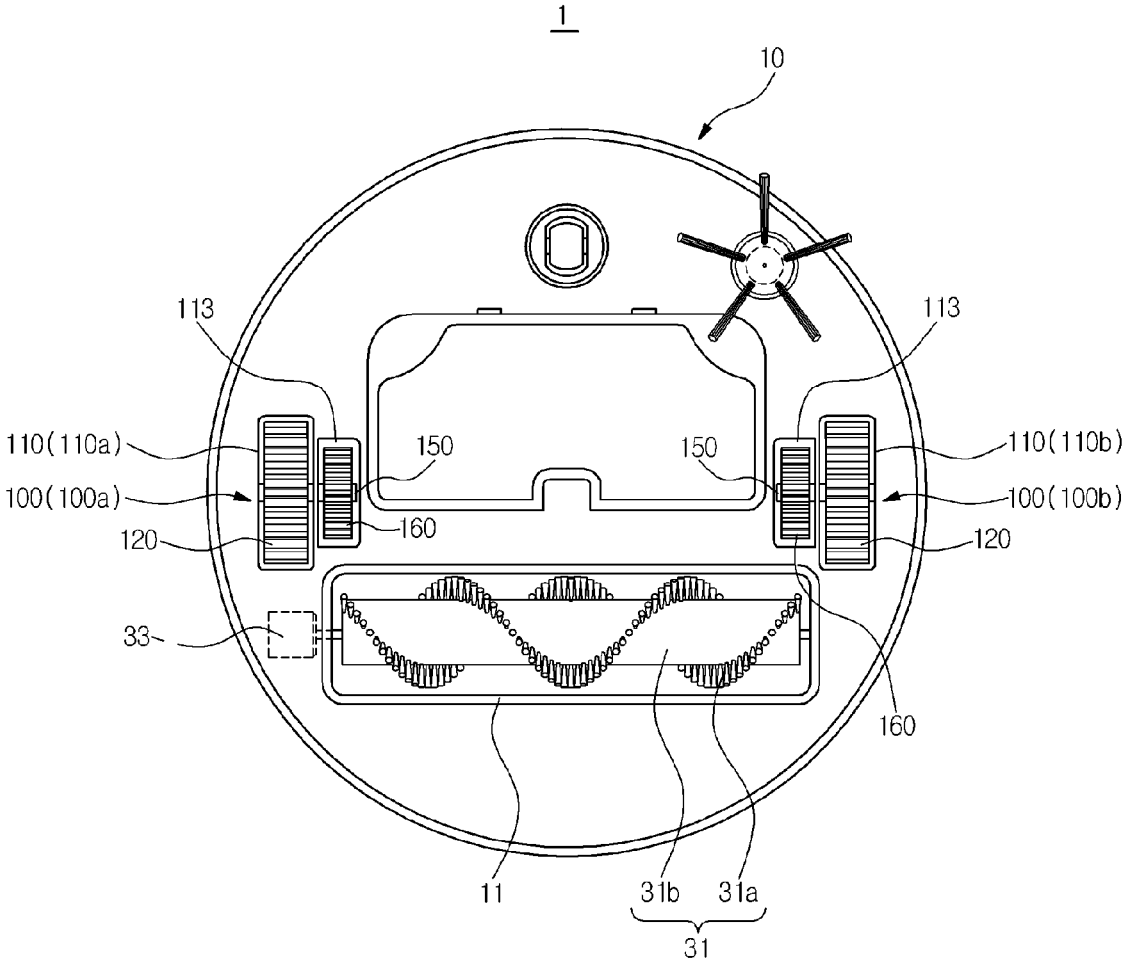
FIG. 2 is a bottom view of the robot cleaner according to the embodiment of the present disclosure.

As shown in FIGS. 1 and 2, a robot cleaner 1 includes a main body 10 defining the external appearance of the robot cleaner, a cover 20 configured to cover the top of the main body 10, a brush unit 30 configured to sweep or scatter dust present in a cleaning space, a power unit 40 to supply power required to drive the main body 10, and drive devices 100 to drive the main body 10.

The main body 10 defines the external appearance of the robot cleaner 1 and supports a variety of elements mounted in the robot cleaner 1.

The cover 20 includes a transparent window 21 to transmit light emitted from an upward camera (not shown) that captures an image of an upper space perpendicular to a traveling direction of the main body 10.

The brush unit 30 includes a main brush 31 fitted into a suction opening 11 that is perforated in a rear region of a bottom surface of the main body 10, a main brush motor 33 to rotate the main brush 31, and a dust container 35 into which impurities, such as dust, swept by the main brush 31, are collected.

The main brush 31 serves to sweep or scatter dust on a floor below the main body 10, improving dust suction efficiency.

The main brush 31 has a drum shape and consists of a roller 31*a* and a brush 31*b*.

To ensure that the main brush 31 cleans a wide cleaning space via one revolution thereof, it may be necessary to provide the main brush 31 with a long length such that left and right ends of the main brush 31 are close to the rim of the main body 10.

Since the main brush 31 is located between main wheels 120 of the drive devices 100 that will be described hereinafter, provision of the long main brush 31 may require an increase in a distance between the main wheels 120 that are mounted to left and right peripheral positions of the main body 10 on the center axis thereof.

To increase the distance between the main wheels 120 to the maximum extent, it may be necessary to locate the main wheels 120 of the drive device 100 toward an outermost portion of the main body 10.

To install the main wheels 120 close to the outermost portion, i.e. the rim of the main body 10, a gear assembly 140 of each drive device 100 may be located closer to the center of the main body 10 than the main wheels 120.

Although not shown, the brush unit 30 may further include side brushes that are arranged at opposite sides of the main brush 31 to sweep dust on a place where the main brush 31 does not reach, improving cleaning efficiency.

The power unit 40 includes a battery 41, which is electrically connected to drive motors 130 that rotates the main wheels 120 and auxiliary wheels 160, the main brush motor 33 that rotates the main brush 31, and other drive devices that drive the main body 10 to supply power thereto.

The battery 41 is a rechargeable secondary battery, and is charged with power supplied from a docking station (not shown) when the main body 10 is docked with the docking station (not shown) after completion of a cleaning operation.

The drive devices 100 are located at opposite sides of the center of the main body 10 and enable advancement, reverse travel, rotation, and other movements of the main body 10 during traveling thereof.

The following description is centered on the drive device 100 located at the right side on the basis of an advancement direction of the main body 10 by way of example, and is equally applied even to the drive device 100 located at the left side on the basis of the advancement direction of the main body 10 so long as it is not specially mentioned.

Figure 3:
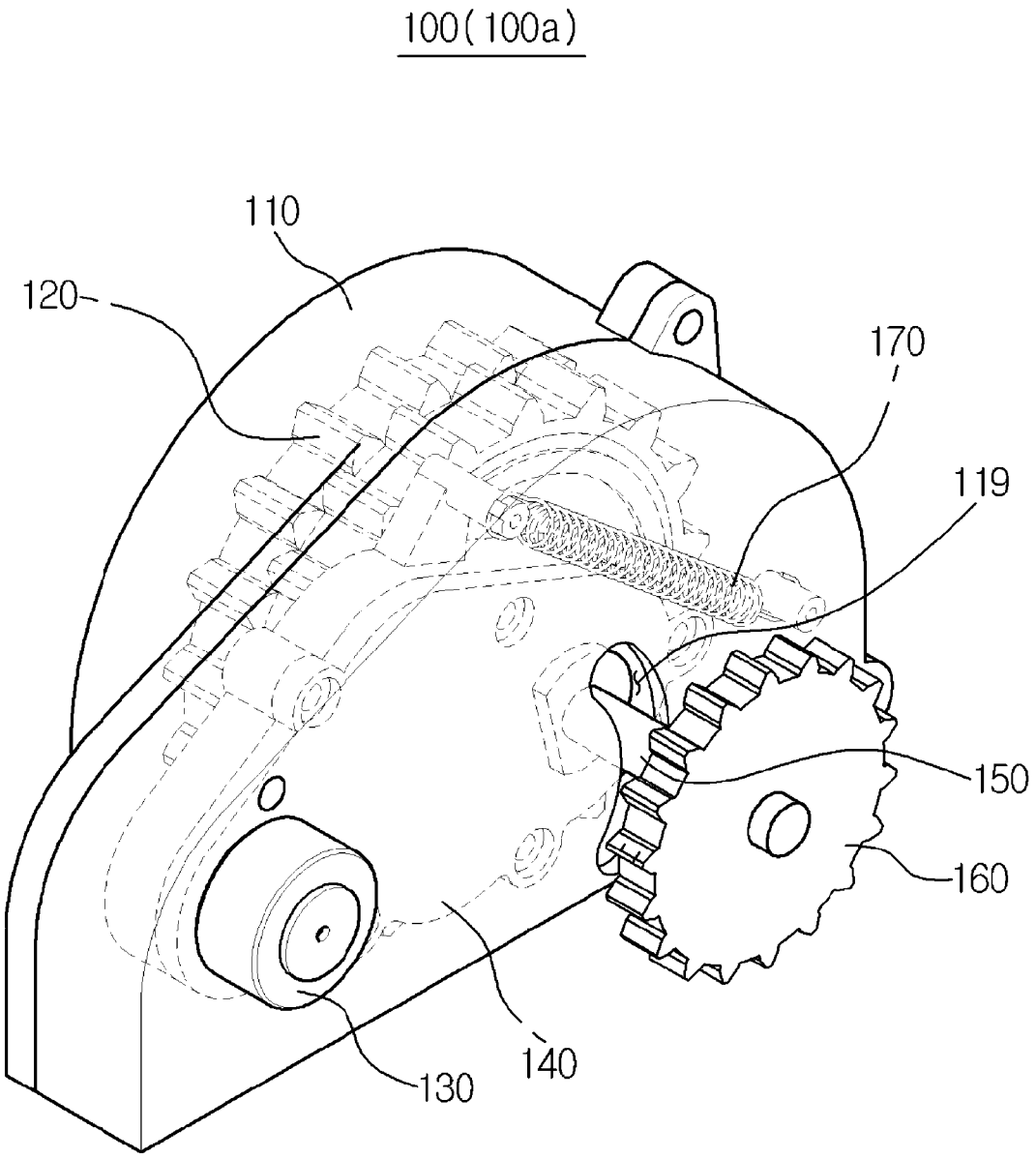
FIG. 3 is a perspective view showing a drive device of the robot cleaner according to the embodiment of the present disclosure.
Figure 4:
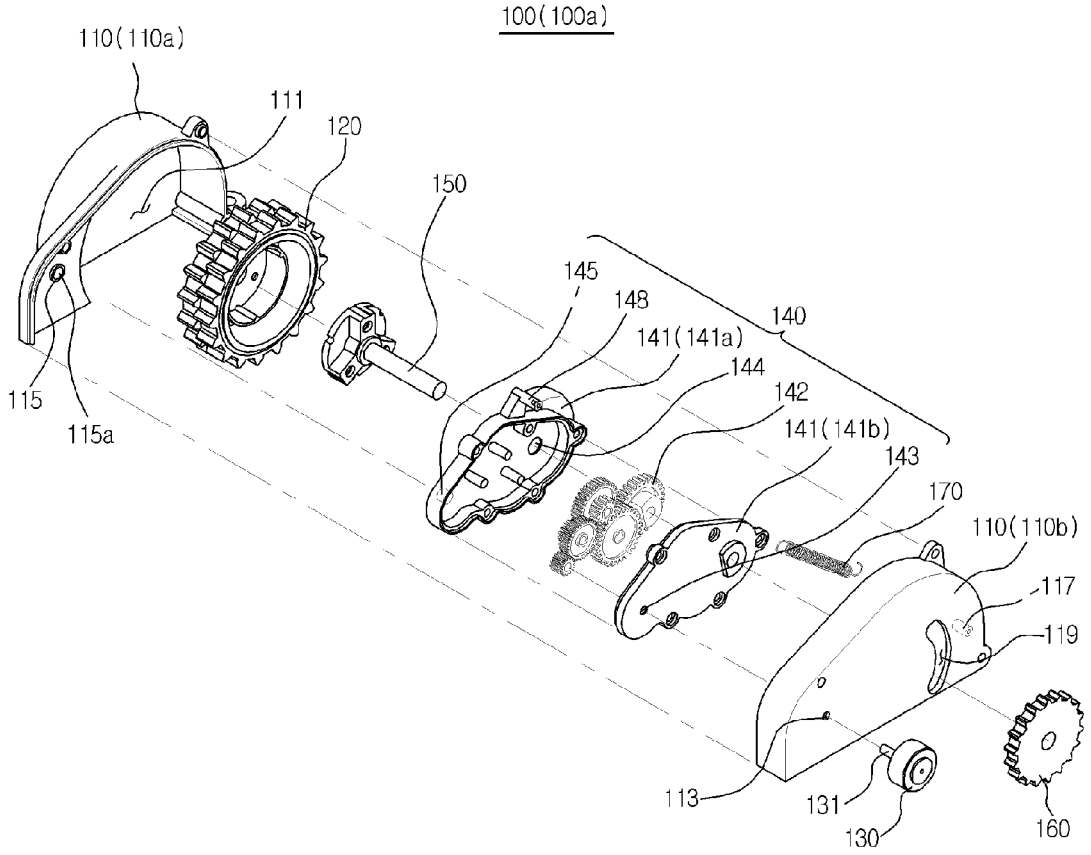
FIG. 4 is an exploded perspective view of the drive device shown in FIG. 3.

As shown in FIGS. 3 and 4, the drive device 100 includes a housing 110, the main wheel 120 to drive the main body 10 during normal travel, the drive motor 130 coupled to one side of the housing 110 to rotate the main wheel 120, the gear assembly 140 placed between the main wheel 120 and the drive motor 130 to transmit drive power of the drive motor 130 to the main wheel 120, a drive shaft 150 extending on the center axis of the main body 10 to interconnect the main wheel 120 and the gear assembly 140 such that the main wheel 120 is rotated by rotation power transmitted from the gear assembly 140, and an auxiliary wheel 160 connected to a distal end of the drive shaft 150 toward the center of the main body 10 to drive the main body 10 during abnormal travel.

The housing 110 includes a receiver 111 in which the main wheel 120 and the gear assembly 140 are received, a first coupling hole 113 for coupling of the drive motor 130, a first coupling boss 115 for coupling of the gear assembly 140, a first support protrusion 117 fitted into one end of an elastic member 170, and a guide slot 119 through which the drive shaft 150 penetrates so as to extend toward the center of the main body 10.

The receiver 111 has an open bottom such that the gear assembly 140 coupled to the housing 110 and the main wheel 120 coupled to the gear assembly 140 are movable up and down according to the kind and state of the floor in the cleaning area.

The first coupling hole 113 is formed in one sidewall 110*b* of the housing 110 to assist a rotating shaft 131 of the drive motor 130 in being coupled to the gear assembly 140 within the housing 110.

The first coupling boss 115 protrudes inward of the housing 110 by a predetermined length from an inner surface of the other sidewall 110*a* that is opposite to the sidewall 110*b* of the housing 110 to which the drive motor 130 is coupled.

The first coupling boss 115 has a center receiving hole 115*a* in which a second coupling boss 145 of the gear assembly 140 is pivotally received, such that the gear assembly 140 is pivotable about the first coupling boss 115.

The first coupling boss 115 may be located on the same axis as the first coupling hole 113 and the rotating shaft 131 of the drive motor 130 that penetrates the first coupling hole 113.

Once the first coupling boss 115 has been located on the same axis as the rotating shaft 131 of the drive motor 130, the gear assembly 140 is pivotable about the rotating shaft 131 of the drive motor 130.

The first support protrusion 117 protrudes inward of the housing 110 by a predetermined length from an inner surface of the sidewall 110*b* of the housing 110 to which the drive motor 130 is coupled. The first support protrusion 117 is fitted into one end of the elastic member 170 that elastically supports the gear assembly 140.

The guide slot 119 is formed in the sidewall 110*b* of the housing 110 such that the drive shaft 150 penetrates the guide slot 119 to thereby extend toward the center of the main body 10. The guide slot 119 provides a movement path along which the drive shaft 150, to which the main wheel 120, the gear assembly 140 and the auxiliary wheel 160 that will be described hereinafter are coupled, is movable to pivot about the first coupling boss 115.

The main wheel 120 is installed to come into direct contact with the floor in the cleaning space so as to enable traveling of the main body 10. The main wheel 120 is connected to the gear assembly 140 via the drive shaft 150 and is rotated upon receiving rotation power transmitted from the gear assembly 140.

The drive motor 130 is coupled to an outer surface of the sidewall 110*b* of the housing 110 in which the first coupling hole 113 is formed. The rotating shaft 131 of the drive motor 130 penetrates the first coupling hole 113 to thereby be coupled to the gear assembly 140 within the housing 110.

As drive power of the drive motor 130 is transmitted to the drive shaft 150 via the rotating shaft 131 and power-transmission gears 142 connected to the rotating shaft 131, rotation of the main wheel 120 is accomplished.

The gear assembly 140 includes a gear case 141, power-transmission gears 142 rotatably engaged with each other within the gear case 141, the second coupling boss 145 to couple the gear assembly 140 and the housing 110 to each other, and a second support protrusion 148 fitted into the other end of the elastic member 170.

The gear case 141 rotatably supports the power-transmission gears 142 therein.

The power-transmission gears 142 are rotatably supported by the gear case 141 while being engaged with each other. The power-transmission gears 142 interconnect the rotating shaft 131 of the drive motor 130 and the drive shaft 150 to transmit drive power of the drive motor 130 to the drive shaft 150.

The rotating shaft 131 may penetrate a second coupling hole 143 formed in one side 141 b of the gear case 141 to thereby be connected to one of the power-transmission gears 142. The drive shaft 150 may penetrate a third coupling hole 144 formed in the other side 141*a* of the gear case 141 to thereby be connected to one of the other power-transmission gears 142 that are not coupled to the rotating shaft 131.

The second coupling boss 145 protrudes, by a predetermined length, from the other side 141*a* of the gear case 141 toward the first coupling boss 115 and is rotatably fitted into the receiving hole 115*a* formed in the first coupling boss 115.

The second support protrusion 148 protrudes from an upper end of the gear case 141 toward the first support protrusion 117 to thereby be fitted into the other end of the elastic member 170 that elastically supports the gear assembly 140.

The gear assembly 140 is pivotally coupled to the housing 110 via the second coupling boss 145, and is elastically supported by the housing 110 via the second support protrusion 148 and the elastic member 170.

The drive shaft 150 is connected to the gear assembly 140 while being fixed to the main wheel 120 to enable rotation of the main wheel 120. The drive shaft 150 interconnecting the main wheel 120 and the gear assembly 140 extends through the housing 110 toward the center of the main body 10.

The auxiliary wheel 160 that will be described hereinafter is coupled to the distal end of the drive shaft 150 toward the center of the main body 10.

Figure 5:
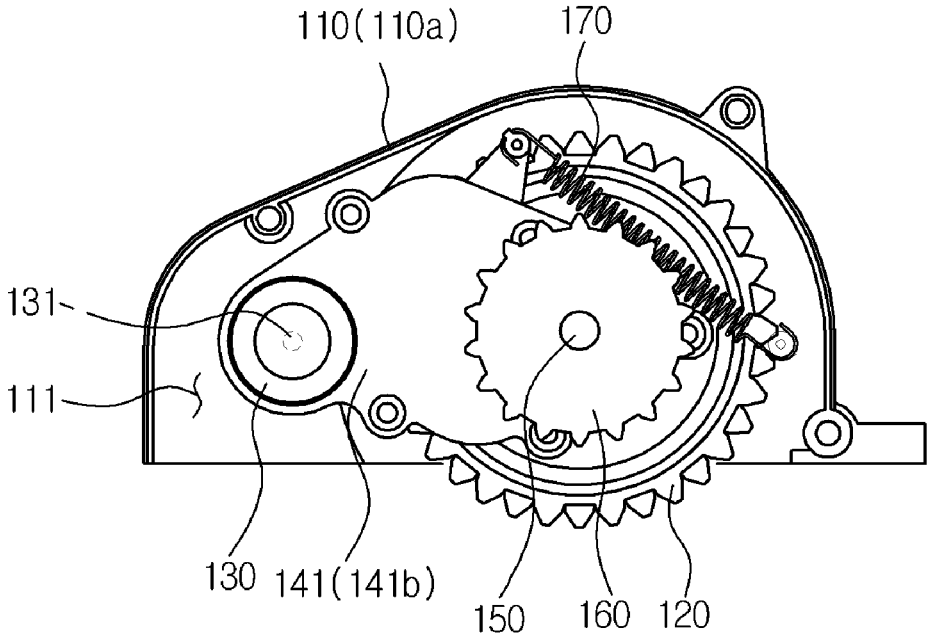
FIGS. 5 to 8 are views showing an up-and-down movement of a main wheel and an auxiliary wheel of the drive device shown in FIG. 3.
Figure 6:
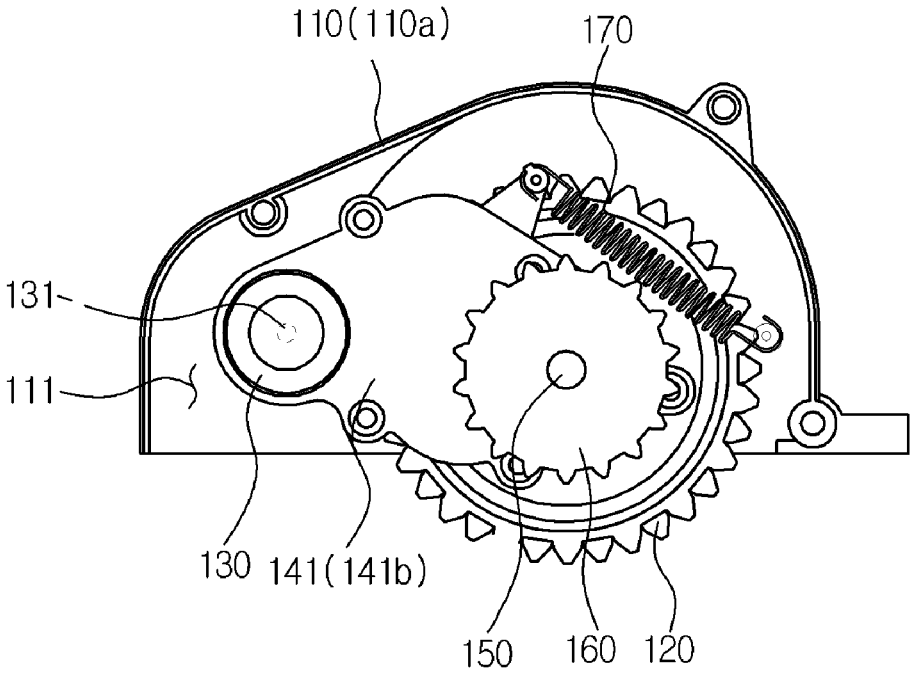

The main wheel 120 and the auxiliary wheel 160 interconnected by the drive shaft 150 are rotated together by drive power of the drive motor 130. As shown in FIGS. 5 and 6, the main wheel 120 and the auxiliary wheel 160 may move up and down by pivoting about the first coupling boss 115.

The auxiliary wheel 160 is connected to the distal end of the drive shaft 150 extending toward the center of the main body 10 fixed to the main wheel 120, thereby being rotated along with the main wheel 120.

The auxiliary wheel 160 is connected to the distal end of the drive shaft 150 that penetrates the housing 110 to thereby extend toward the center of the main body 10. Thus, the auxiliary wheel 160 is located outside of the housing 110.

Although not shown in the drawings, the auxiliary wheel 160 may be located inside the housing 110.

Since the auxiliary wheel 160 is located outside of the housing 110, to allow the auxiliary wheel 160 to move up and down along with the main wheel 120 that is moved up and down within the housing 110, the main body 10 is provided at the bottom thereof with an auxiliary hole 113 for upward and downward movement of the auxiliary wheel 160.

The auxiliary wheel 160 may have an outer diameter less than that of the main wheel 120. This ensures that the auxiliary wheel 160 does not protrude downward of the main body 10 during normal travel of the robot cleaner 1.

As shown in FIGS. 5 and 6, during normal travel of the robot cleaner 1, the auxiliary wheel 160 does not protrude downward of the main body 10, and therefore the robot cleaner 1 is driven by the main wheel 120.

However, if the robot cleaner 1 is no longer driven by the main wheel 120 as the center of the main body 10 is caught by an obstacle, such as a doorsill, etc., during traveling of the robot cleaner 1, the auxiliary wheel 160 is moved to protrude downward of the main body 10 so as to drive the robot cleaner 1.

Figure 7:
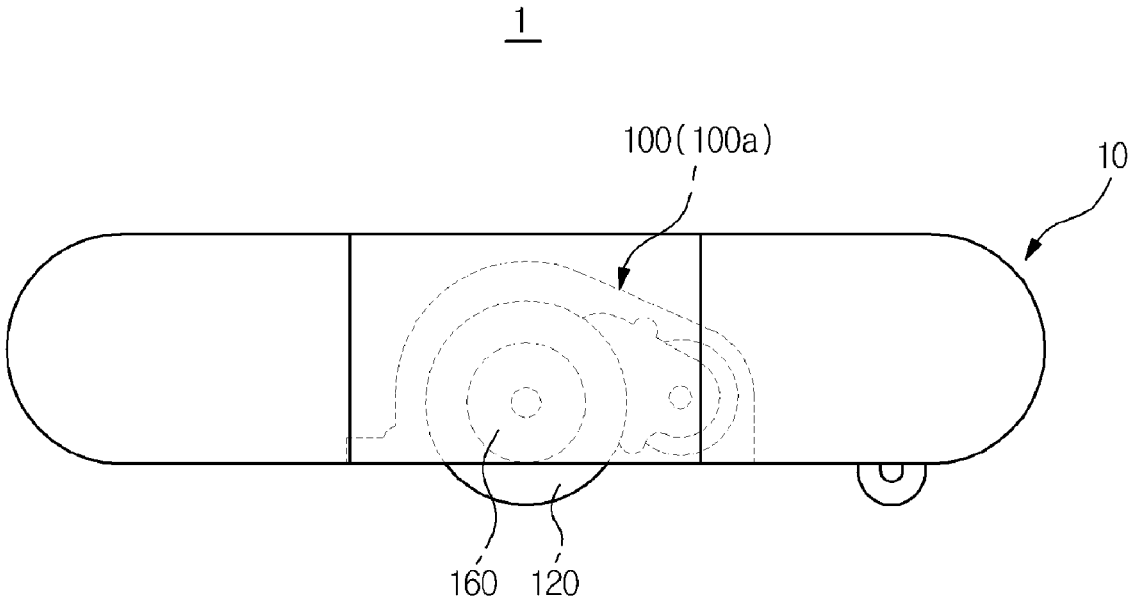
Figure 8:
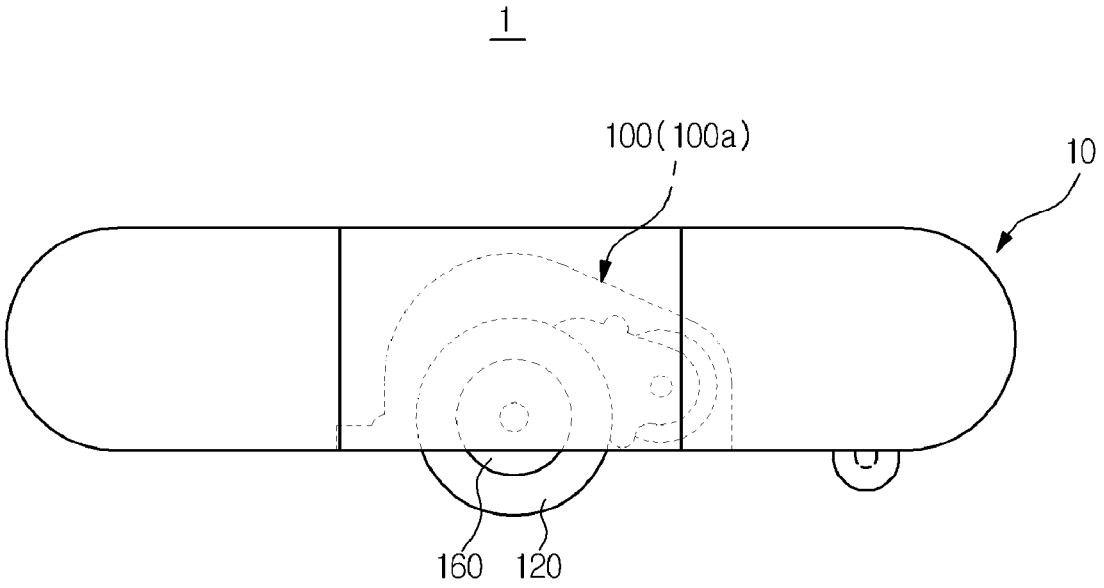
Figure 9:
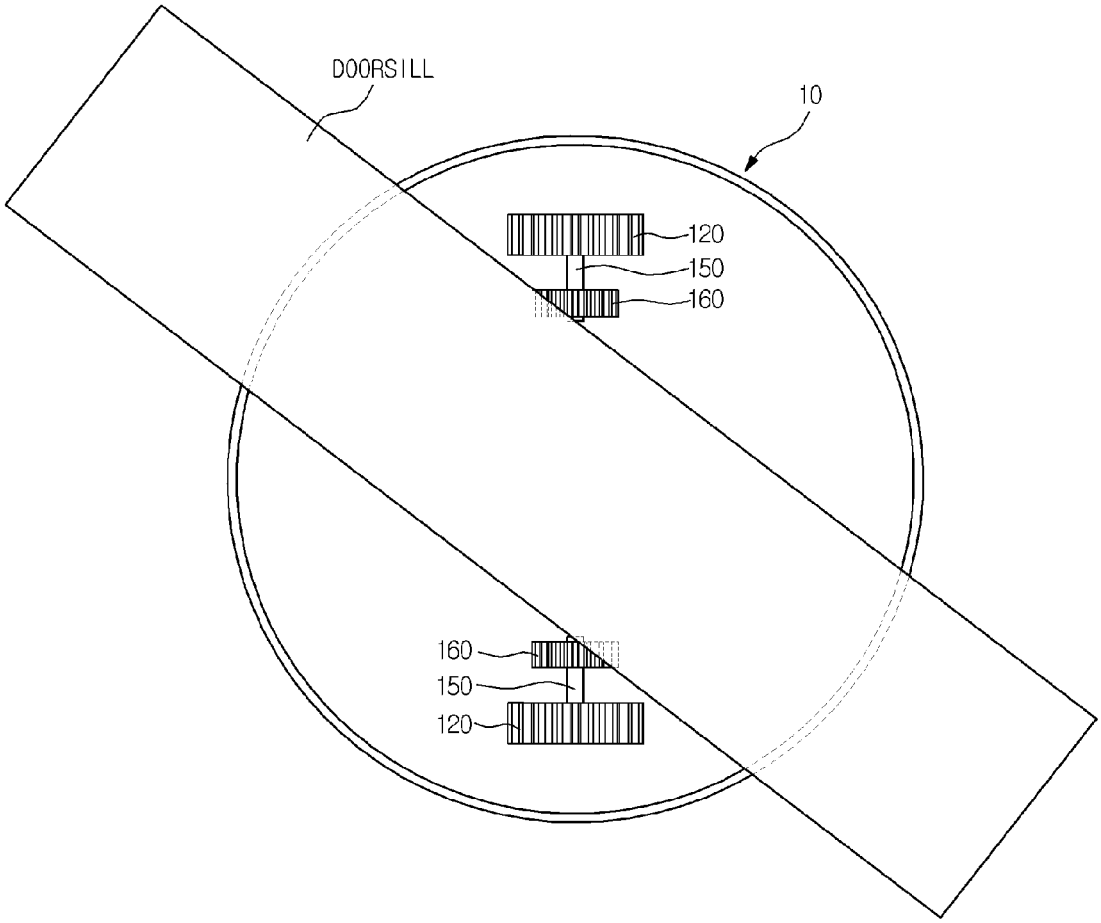
FIG. 9 is a view showing a state when the auxiliary wheel of the robot cleaner according to the embodiment of the present disclosure passes over an obstacle.

Considering driving of the robot cleaner 1 by the auxiliary wheel 160 as described above, as shown in FIGS. 7 to 9, if the center of the main body 10 is caught by an obstacle, such as a doorsill, etc., as the robot cleaner 1 passes over the obstacle during traveling, the main wheel 120 of the robot cleaner 1 is lifted to the air rather than touching the floor.

Once the main wheel 120 does not come into contact with the floor, the auxiliary wheel 160 connected to the main wheel 120 via the drive shaft 150 is rotated clockwise about the first coupling boss 115 of the housing 110 along with the main wheel 120, thereby protruding downward of the main body 10.

Since the auxiliary wheel 160 is located closer to the center of the main body 10 than the main wheel 120, even if the center of the main body 10 is caught by the obstacle and does not come into contact with the floor, the auxiliary wheel 160 protruding downward of the main body 10 may reach the floor. As such, the robot cleaner 1 may escape from the obstacle by driving of the auxiliary wheel 160 coming into contact with the floor.

Once the robot cleaner 1 has escaped from the obstacle, the main wheel 120 reaches the floor, and then is moved upward by rotating counterclockwise about the first coupling boss 115 of the housing 110. The auxiliary wheel 160 connected to the main wheel 120 via the drive shaft 150 is also moved upward by rotating counterclockwise about the first coupling boss 115 of the housing 110 along with the main wheel 120, and thus no longer protrudes downward of the main body 10.

As is apparent from the above description, a robot cleaner according to the embodiments of the present disclosure may stably perform a cleaning operation without interruption of travel while the robot cleaner passes over an obstacle, such as a doorsill, etc., present in a cleaning space.

Although the above description is centered on the specific shape and movement direction of the robot cleaner with reference to the accompanying drawings, it would be appreciated by those skilled in the art that various changes may be made in these embodiments without departing from the principles and spirit of the invention, the scope of which is defined in the claims and their equivalents.

What is claimed is:

1. A robot cleaner comprising a main body and drive devices installed respectively at left and right peripheral positions on the basis of the center of the main body to drive the main body, wherein each of the drive devices includes:

a main wheel to drive the main body;

a drive motor to generate rotation power required to rotate the main wheel;

a gear assembly to transmit rotation power of the drive motor to the main wheel;

a drive shaft to interconnect the gear assembly and the main wheel so as to assist the main wheel in rotating by rotation power transmitted from the gear assembly, the drive shaft extending from the main wheel toward the center of the main body; and an auxiliary wheel to drive the main body, the auxiliary wheel being connected to a distal end of the drive shaft extending toward the center of the main body so as to be located closer to the center of the main body than the main wheel, and wherein, if the main wheel is lifted from a floor as the main body is caught at the center thereof by an obstacle when passing over the obstacle during traveling, the auxiliary wheel protrudes downward of the main body to reach the floor, assisting the main body in traveling to escape from the obstacle.

2. The robot cleaner according to claim 1, wherein:

the main body includes a main brush to sweep or scatter dust present in a cleaning space; and the main brush is installed between the main wheels at a rear bottom region of the main body.

3. The robot cleaner according to claim 2, wherein the main brush extends lengthwise such that left and right ends of the main brush are located close to the rim of the main body.

4. The robot cleaner according to claim 3, wherein:

the main wheels are installed close to left and right rim positions of the main body to allow the left and right ends of the main brush between the main wheels to be located adjacent to the rim of the main body; and the gear assembly is installed between a corresponding one of the main wheels and the center of the main body.

5. The robot cleaner according to claim 1, wherein:

the drive device includes a housing in which the main wheel and the gear assembly are received; and the housing has an open bottom to enable upward and downward movement of the main wheel.

6. The robot cleaner according to claim 5, wherein:

the housing has a first coupling hole for insertion of a rotating shaft of the drive motor; and the gear assembly has a second coupling hole for insertion of the rotating shaft inserted into the first coupling hole.

7. The robot cleaner according to claim 6, wherein:

the housing has a first coupling boss aligned on the same axis as the rotating shaft so as to be coupled to the gear assembly;

the gear assembly has a second coupling boss to couple the gear assembly to the housing; and the first coupling boss has a receiving hole in which the second coupling boss is pivotally received such that the gear assembly is pivotable about the first coupling boss.

8. The robot cleaner according to claim 7, wherein:

the gear assembly has a third coupling hole for insertion of the drive shaft; and the housing has a guide slot for penetration of the drive shaft inserted into the third coupling hole, whereby the drive shaft having passed through the guide slot extends toward the center of the main body.

9. The robot cleaner according to claim 8, wherein the auxiliary wheel is connected to a distal end of the drive shaft penetrating the guide slot, and is located outside of the housing.

10. The robot cleaner according to claim 9, wherein:

the main wheel, the gear case and the auxiliary wheel, which are connected to one another via the drive shaft, are moved upward and downward via rotation thereof about the rotating shaft of the drive motor; and the guide slot guides rotation of the drive shaft about the rotating shaft.

11. The robot cleaner according to claim 10, wherein an outer diameter of the auxiliary wheel is less than an outer diameter of the main wheel.

12. A robot cleaner comprising a main body, a main brush installed at a rear bottom region of the main body, and drive devices installed respectively at left and right peripheral positions on the basis of the center of the main body to drive the main body, wherein each of the drive devices includes:

a main wheel to drive the main body;

a drive motor to generate rotation power required to rotate the main wheel;

a gear assembly to transmit rotation power of the drive motor to the main wheel;

a drive shaft to interconnect the gear assembly and the main wheel so as to assist the main wheel in rotating by rotation power transmitted from the gear assembly; and an auxiliary wheel connected to the drive shaft to drive the main body, the auxiliary wheel being located closer to the center of the main body than the main wheel, and wherein the main wheel is located closer to the rim of the main body than the gear assembly to allow the main brush between the main wheels to extend lengthwise such that left and right ends of the main brush are located adjacent to the rim of the main body.

13. The robot cleaner according to claim 12, wherein, if the main wheel is lifted from a floor as the main body is caught at the center thereof by an obstacle when passing over the obstacle during traveling, the auxiliary wheel protrudes downward of the main body to reach the floor, assisting the main body in traveling to escape from the obstacle.

14. The robot cleaner according to claim 12, wherein:

the drive device includes a housing in which the main wheel and the gear assembly are received; and the housing has an open bottom to enable upward and downward movement of the main wheel.

15. The robot cleaner according to claim 14, wherein:

the housing has a first coupling hole for insertion of a rotating shaft of the drive motor; and the gear assembly has a second coupling hole for insertion of the rotating shaft inserted into the first coupling hole.

16. The robot cleaner according to claim 15, wherein:

the housing has a first coupling boss aligned on the same axis as the rotating shaft so as to be coupled to the gear assembly;

the gear assembly has a second coupling boss to couple the gear assembly to the housing; and the first coupling boss has a receiving hole in which the second coupling boss is pivotally received such that the gear assembly is pivotable about the first coupling boss.

17. The robot cleaner according to claim 16, wherein:

the gear assembly has a third coupling hole for insertion of the drive shaft; and the housing has a guide slot for penetration of the drive shaft inserted into the third coupling hole, whereby the drive shaft having passed through the guide slot extends toward the center of the main body.

18. The robot cleaner according to claim 17, wherein the auxiliary wheel is connected to a distal end of the drive shaft penetrating the guide slot, and is located outside of the housing.

19. The robot cleaner according to claim 18, wherein:

the main wheel, the gear case and the auxiliary wheel, which are connected to one another via the drive shaft, are moved upward and downward via rotation thereof about the rotating shaft of the drive motor; and the guide slot guides rotation of the drive shaft about the rotating shaft.

20. The robot cleaner according to claim 19, wherein an outer diameter of the auxiliary wheel is less than an outer diameter of the main wheel.

21. The robot cleaner according to claim 1, wherein an elastic member causes at least the auxiliary wheel to protrude downward of the main body to reach the floor if a force applied to the elastic member is removed.

22. The robot cleaner according to claim 21, wherein the force applied to the elastic member is a weight of the robot.

23. The robot cleaner according to claim 13, wherein an elastic member causes at least the auxiliary wheel to protrude downward of the main body to reach the floor if a force applied to the elastic member is removed.

24. The robot cleaner according to claim 23, wherein the force applied to the elastic member is a weight of the robot.

* * * * *